US010329803B1

(12) United States Patent
Lieser

(10) Patent No.: US 10,329,803 B1
(45) Date of Patent: Jun. 25, 2019

(54) GATE LATCH

(71) Applicant: Gene Lieser, Magnolia, TX (US)

(72) Inventor: Gene Lieser, Magnolia, TX (US)

( * ) Notice: Subject to any disclaimer, the term of this patent is extended or adjusted under 35 U.S.C. 154(b) by 376 days.

(21) Appl. No.: 15/268,216

(22) Filed: Sep. 16, 2016

Related U.S. Application Data

(60) Provisional application No. 62/307,851, filed on Mar. 14, 2016, provisional application No. 62/274,100, filed on Dec. 31, 2015.

(51) Int. Cl.
*E05B 65/00* (2006.01)
*E05C 3/06* (2006.01)
*E05B 1/00* (2006.01)

(52) U.S. Cl.
CPC ..... *E05B 65/0007* (2013.01); *E05B 1/0053* (2013.01); *E05C 3/06* (2013.01)

(58) Field of Classification Search
CPC ..... E05B 65/0007; E05B 15/0093; A01K 1/0017; Y10T 16/31; Y10T 292/1006; Y10T 292/1063; Y10S 292/13; Y10S 292/29; E06B 11/021; E05Y 2900/40
See application file for complete search history.

(56) References Cited

U.S. PATENT DOCUMENTS 753,857 A 3/1904 Correll
2,074,759 A * 3/1937 Richards ..... E05B 65/0007 292/213
2,577,930 A 6/1951 Thomas
2,666,660 A * 1/1954 Youngworth ..... E05B 65/0007 292/205
3,520,567 A 7/1970 VanGilst
3,888,527 A * 6/1975 Haisler ..... A01K 1/0017 292/213
4,531,769 A 7/1985 Glancy
4,962,953 A 10/1990 Priefert
5,226,684 A * 7/1993 De La Garza ..... E05B 65/0007 292/213
5,868,446 A 2/1999 Rossmo
6,058,747 A 5/2000 Doyle et al.
6,471,261 B1 * 10/2002 Messler ..... E05B 65/0007 292/205
6,679,530 B2 1/2004 Krynski
7,878,558 B1 2/2011 Bell
8,544,149 B1 * 10/2013 Faber ..... E05D 7/12 16/256
2004/0168652 A1 9/2004 Priefert
2010/0156119 A1 6/2010 Mueller et al.
2014/0215924 A1 8/2014 Evans
2016/0326783 A1 * 11/2016 Bledsoe ..... E05C 3/16

* cited by examiner

*Primary Examiner* — Mark A Williams
(74) *Attorney, Agent, or Firm* — Harrison Law Office, P.C.

(57) ABSTRACT

A gate latch configured to enable opening and closing thereof with only one hand. Comprises an integrated housing with an internal slide caused to move from a first position at one end of a slide sleeve member to a second position at an opposite end thereof, functionally related to corresponding pivotable movement of a fork member. When the fork member is disposed in a first, orthogonal position the gate latch is closed wherein a lip member is interlocked with a mated tongue member. When the fork member is disposed in a second, linear position the latch is open wherein the lip member is disengaged from the mated tongue member.

7 Claims, 9 Drawing Sheets

GATE LATCH

RELATED APPLICATIONS

This application claims priority based upon U.S. Provisional Application Ser. No. 62/274,100 filed Dec. 31, 2015 and based upon U.S. Provisional Application Ser. No. 62/307,851 filed Mar. 14, 2016, both of which are incorporated herein by reference.

FIELD OF THE INVENTION

The present invention generally relates to a gate latch, and more particularly relates to a gate latch apparatus having a substantially linear and inherently animal-resistant structure which can be opened and closed via single-handed manipulation by a pedestrian or equestrian ranch-hand or like practitioner.

BACKGROUND OF THE INVENTION

As is well known by practitioners in the art, fence enclosures on a farm or ranch must be adequately latched to prevent livestock or other domestic animals from escaping safe confinement causing potential damage to property, to others and to themselves. Furthermore, gate latches must not only adequately secure fences and the like, but also must be configured to prevent such livestock and other domestic animals from releasing latch mechanisms and immediately thereafter opening gates.

While there have been attempts in the art to incorporate gate latches that satisfy these and other prerequisites, none have been characterized by simple structure and being inexpensive, while enabling an rancher or farmhand to expeditiously and safely open and close a latched gate simultaneously with both enabling the equestrian to safely come into close proximity with the gate latch and sustain contact with the horse while manipulating the latch.

Thus, the present invention teaches a gate latch that enables one-hand maneuvering by an equestrian or other ranch hand or farmhand thereby enabling the other hand to concentrate on controlling a horse or other domestic animal, and also preventing opening of a fence gate by livestock or the like.

SUMMARY OF THE INVENTION

The present invention teaches a gate latch apparatus configured with a streamline structure that enables an equestrian to maneuver in close proximity to a fence gate to conveniently reach the gate latch and also to open and close a fence gate with only one hand wherein the horse reins may be simultaneously and continuously controlled with the other hand without interruption thereof. Embodiments of the present invention are structured to routinely accommodate recurring problems associated with fences and concomitant fence gates, wherein settling tends to cause misalignment and undue separation thereof, effecting consequent malfunction of commonly-used latching and unlatching mechanisms. Hence, unlike the prior art, embodiments of the present invention are configured with a latch assembly having sufficiently sized breadth to be inherently capable of securably performing normal fence-gate-latching functionality due to affording more gate-to-fence holding power than has heretofore been achievable in the art.

As will be hereinafter described, embodiments of the present invention comprise an integrated housing with an internal slide that is caused to move from a first position at one end of a slide sleeve member to a second position at an opposite end thereof, functionally related to corresponding pivotable movement of a preferably horseshoe-shaped fork member. When the fork member is disposed in a first, horizontal position the latch is closed and when the fork member is disposed in a second, linear position the latch is open. It will become apparent to those concersant in the art that embodiments hereof utilize a gravity-biased locking bolt member that provides "catch-latch" functionality attributable to cooperation between internal interlocked tongue and lip members.

As will also be appreciated by practitioners in the art, embodiments of the present invention are also configured with sufficient clearance to enable an equestrian to easily insert a finger, typically a thumb, into the slide bolt sleeve member in order to raise the concomitant slide member release lever that activates the catch-latch methodology taught herein. Notwithstanding, it will be understood that this clearance must not be so large as to enable a farm or ranch animal to penetrate the slide bolt sleeve to activate gate-unlatching as contemplated hereunder.

It is an object and advantage of embodiments of the present invention to provide a convenient and inexpensive gate latch for opening and closing with only one-hand, while the other hand is controlling movement of a horse or other farm or ranch animal.

It is another object of the present invention to provide a gate latch that may be opened and closed by an equestrian while sustaining one-handed contact with the horse and one-handed manipulation of the latch.

It is yet another object of the present invention to provide a gate latch apparatus that enables an equestrian ranch-hand or farm-hand to position the horse proximal to the gate whereupon one-handed opening and closing of the gate latch may be effectuated.

These and other objects and advantages of the present invention will become apparent from the following specification and accompanying drawings.

DETAILED DESCRIPTION

Figure 1:
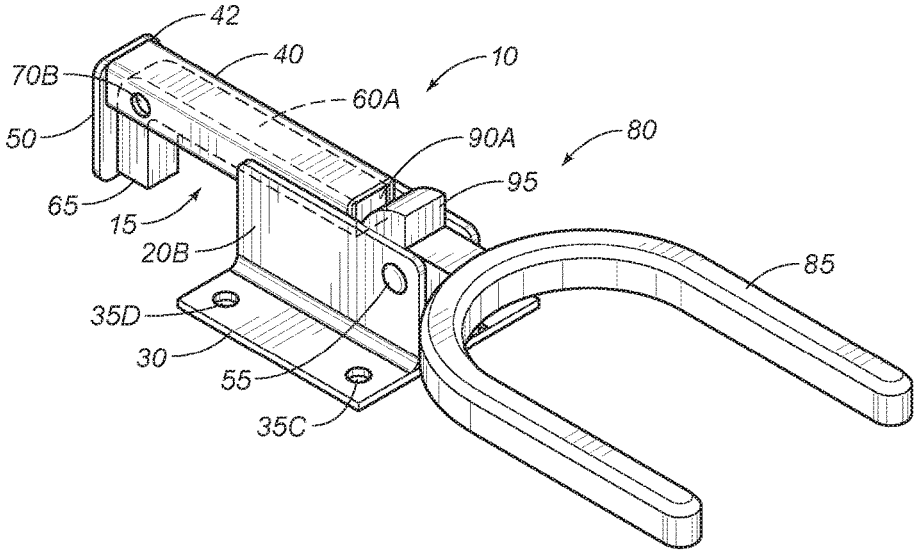
FIG. 1 depicts a frontal perspective view of a gate latch embodiment of the present invention disposed in an open position.
Figure 1A:
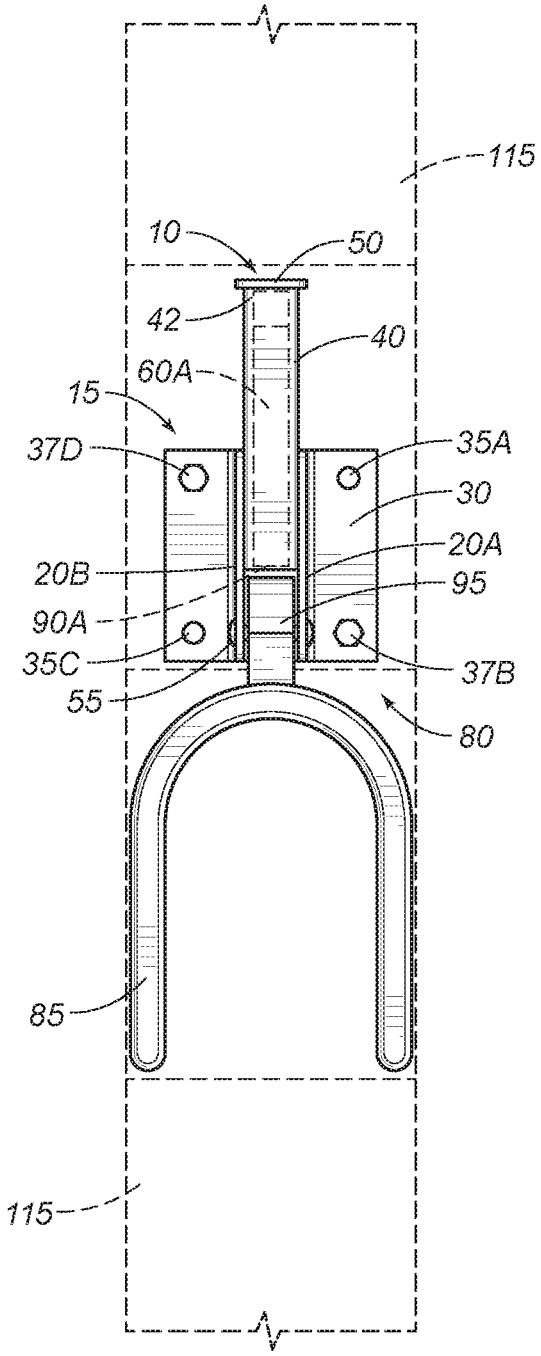
FIG. 1A depicts a frontal view of the gate latch embodiment illustrated in FIG. 1, mounted on a fence post.
Figure 1B:
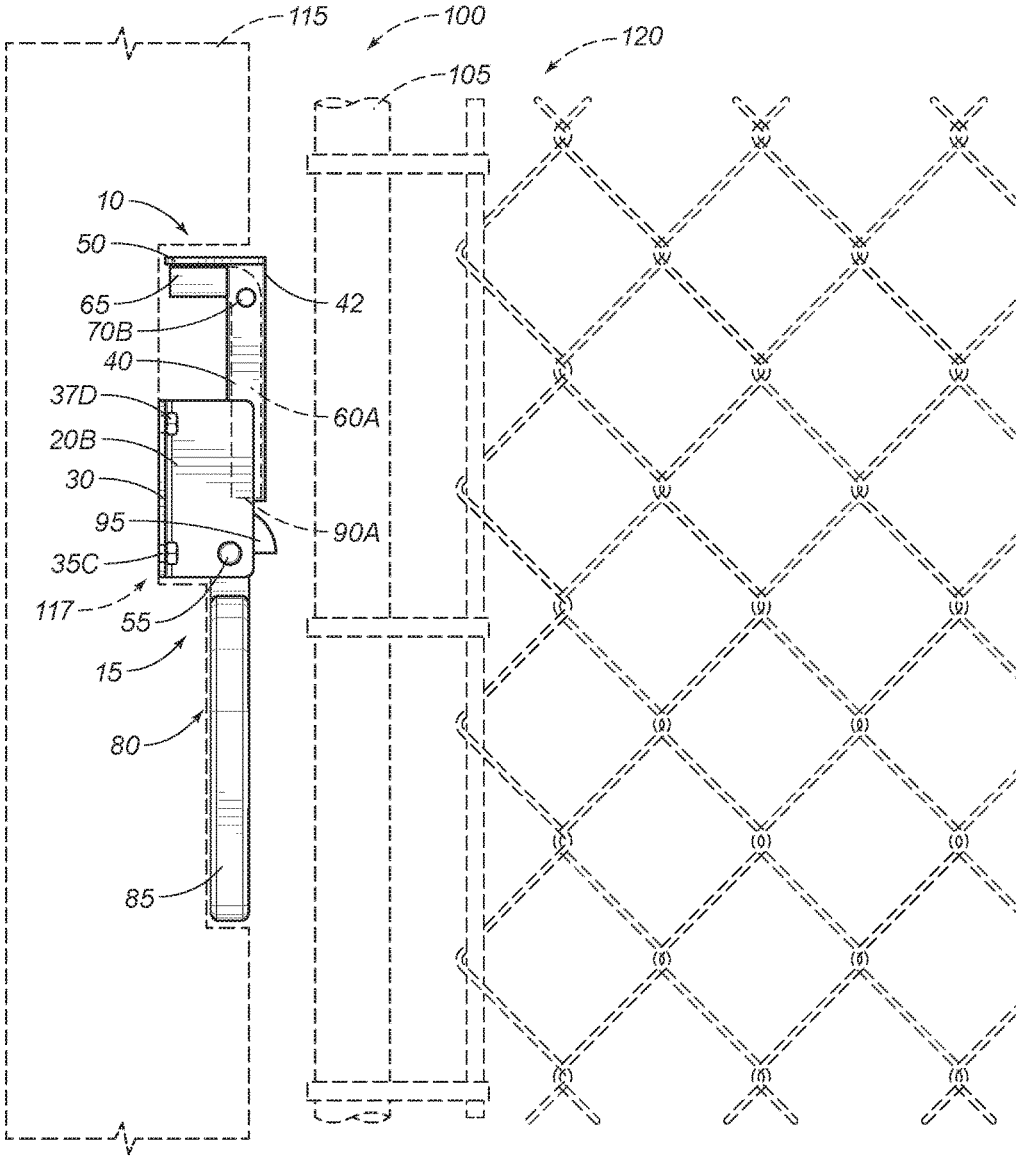
FIG. 1B depicts a left side view of the gate latch embodiment illustrated in FIG. 1A.
Figure 2:
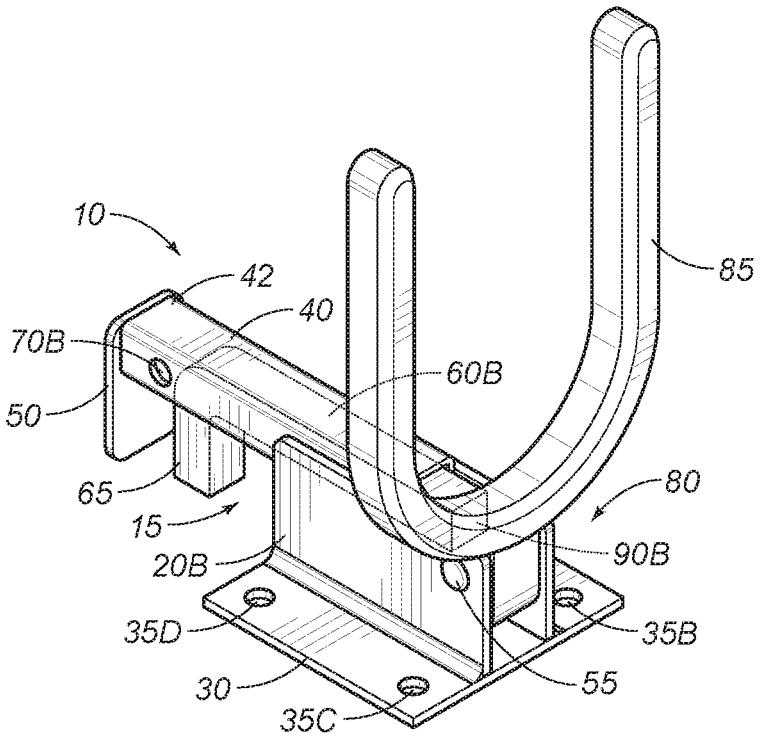
FIG. 2 depicts a frontal perspective view of the gate latch embodiment illustrated in FIG. 1, disposed in a closed position.
Figure 2A:
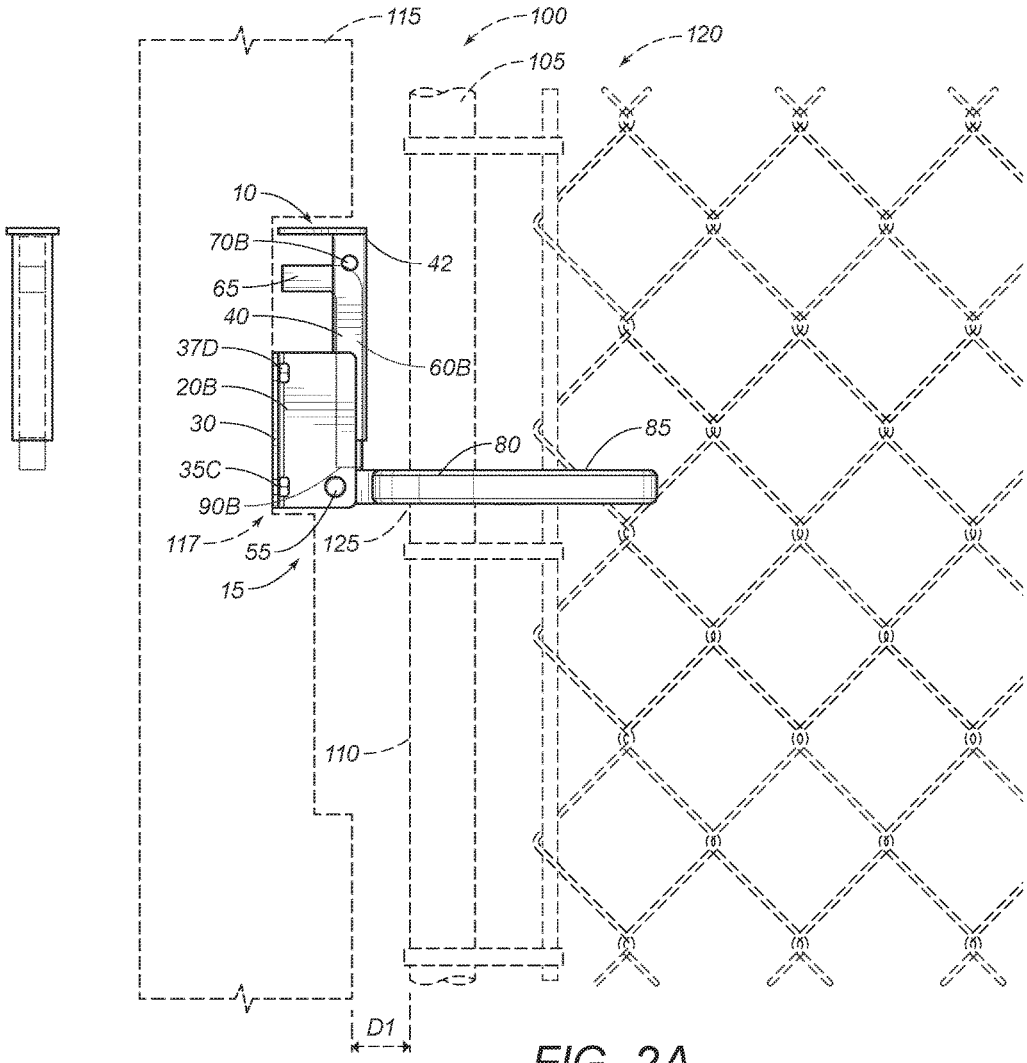
FIG. 2A depicts a left side view of the gate latch embodiment illustrated in FIG. 2, mounted on a fence post and closing a gate.
Figure 7:
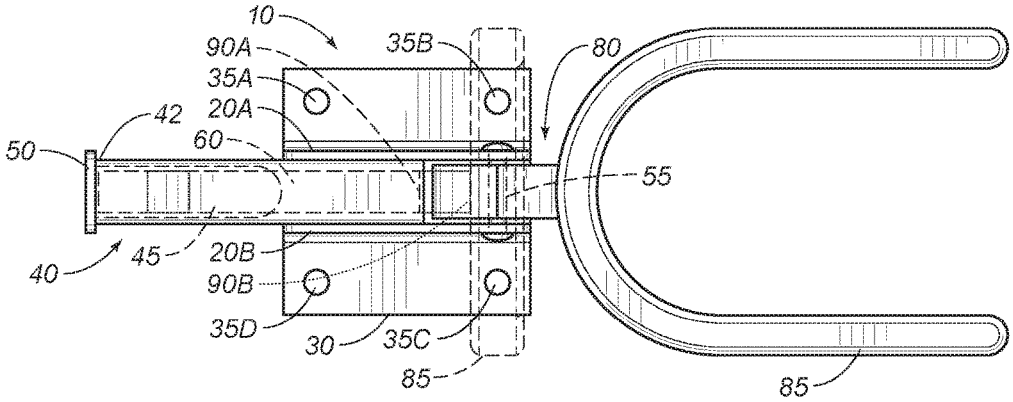
FIG. 7 depicts a top view of the open latch embodiment illustrated in FIGS. 1, 1A and 1B, with the corresponding closed latch position illustrated in FIGS. 2 and 2A depicted with dotted lines.
Figure 8:
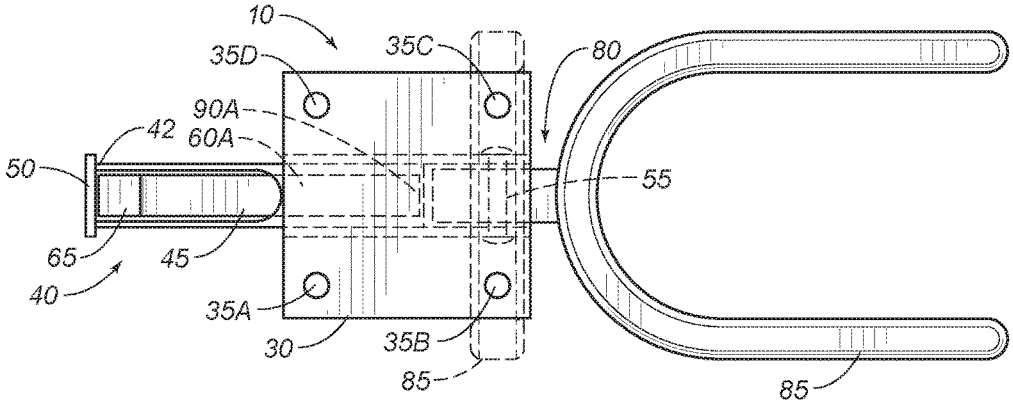
FIG. 8 depicts a bottom view of the open latch embodiment illustrated in FIGS. 1, 1A and 1B, with the corresponding closed latch disposition illustrated in FIGS. 2 and 2A depicted with dotted lines
Figure 9:
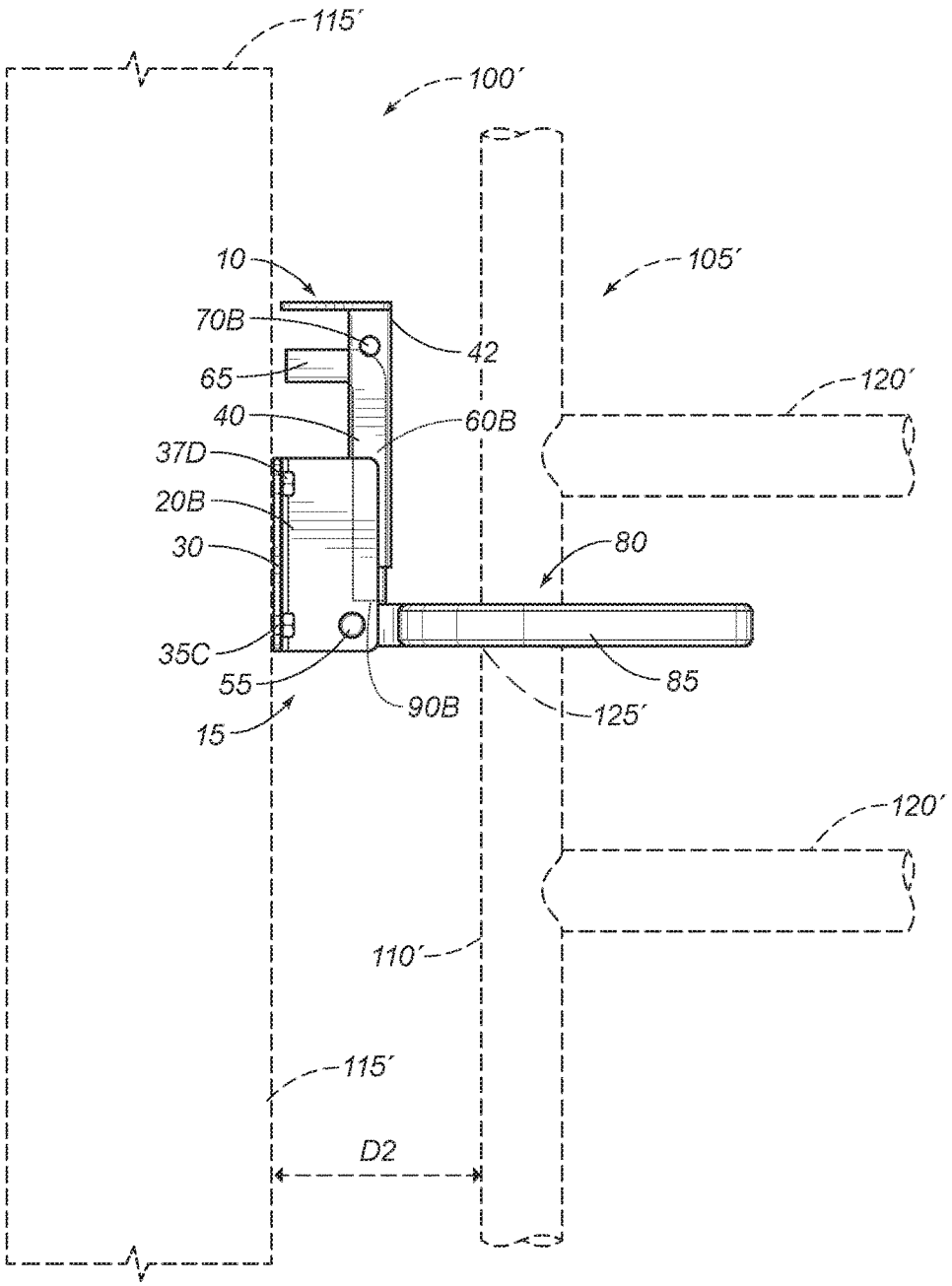
FIG. 9 depicts a left side view of a gate latch embodiment of the present invention mounted on a fence post disposed in a closed position, as depicted in FIGS. 2 and 2A, attached to a fence post even though being significantly separated from each other.

Reference is made herein to the figures in the accompanying drawings in which like numerals refer to like components. Referring collectively to FIGS. 1-9, there are depicted various views of preferred animal-resistant gate latch embodiments of the present invention. As will be elucidated hereinafter, FIGS. 1, 1A and 1B depict instant gate latch embodiments disposed in an open unlatched position. On the other hand, FIGS. 2, 2A and 9 depict instant gate latch embodiments disposed in a closed latched position. More particularly, focusing on FIGS. 1 and 2, there is depicted gate latch embodiment 10 comprising housing member 15 having a longitudinal axis bounded by a pair of parallel spaced-apart preferably congruent side wall members 20A and 20B fixedly disposed on opposite side of slide sleeve member 40, respectively, of housing member 15. Slide retainer member 50 is fixedly disposed substantially orthogonally of slide sleeve member 40 at remote end thereof 42. It will be seen that slide sleeve member 40 is preferably configured in a contiguous relationship with pair of housing side wall members 20A and 20B, and also configured in a contiguous relationship with planar mounting plate member 30. Fork assembly 80 is pivotally engaged with pair of housing side wall members 20A and 20B by substantially vertical rotational movement of fork member 85 about pivot pin member 55, i.e., pivoting substantially in a vertical plane, facilitated by cooperation between slide member release lever 65 at one end of housing member 15 and lip member 95 in conjunction with paired tongue member 90 as will be hereinafter described.

As illustrated in FIGS. 1A, 1B, 2A, and 9, there are depicted frontal and side views of instant gate latch embodiment 10 mounted in situ on a simplified and truncated gate-fence-post assembly 100 typically located at a ranch or farm. FIGS. 1B, 2A and 9 illustrate instant gate latch apparatus 10 in situ affixed to fence post 115 for being latched and unlatched, as appropriate, with respect to fence assembly 120. Accordingly, mounting plate member 30 of gate latch embodiment 10 is affixed to an appropriate portion 117 on a vertical edge of fence post 115 via plurality of bolts 37A-D secured to fence post 115 through corresponding plurality of suitably-sized bolt holes 35A-D. As shown, each of plurality of bolt holes 35A-D is preferably disposed in each corner of mounting plate member 30 to assure a secure connection of mounting plate member 30 to a facing surface of fence post 115 or the like.

It will be understood by those skilled in the art that gate latch apparatus 10 contemplated hereunder would typically be fixedly mounted upon a suitably situated substantially planar surface of conventional fence post 115 essentially disposed opposite and adjacent corresponding proximal vertical edge 110 of mated gate member 105. The simplified views depicted herein illustrate gate-fence post assembly 100 comprising proximal edge 110 of fence gate member 105 disposed opposite and adjacent fence portion 125 of fence post 115 and, in turn, affixed to fence assembly 120.

As contemplated by the present invention, preferably horseshoe-shaped fork member 85 of fork assembly 80 would be releasably secured to fence post 115 and then, in turn, would conveniently be manually manipulated about pivot pin member 55 by a free hand of an equestrian or pedestrian ranch-hand or the like (not shown) to be latched to, or to be unlatched from, fence gate 105—at its proximal vertical edge 110. In particular, FIGS. 1A and 1B depict fence gate 105 in an open position, wherein fork member 85 is disposed in a linear orientation, i.e., fork member 85 and housing member 15 are linearly aligned. Similarly, as depicted in FIG. 1B, fork member 85 is shown hanging downwardly under the influence of gravitational forces, i.e., via a gravity bias, and disengaged from fence gate member 105.

On the other hand, referring now to FIGS. 2A and 9, fence gate 105 is now depicted in a closed position, i.e., with fork member 85 engaged substantially orthogonally with proximal vertical edge portion 110 of fence gate 105. For example, in FIG. 2A, fork member 85 is shown engaged substantially orthogonally with vertical edge portion 110 of fence gate 105 at portion 125 thereof. It will be appreciated that fence gate 105 is pivotably mounted upon a proximate edge 117 of gate post 110 (not shown) and configured for fork member 85 to be received at vertical edge portion 125 thereof. Alternatively, when this fence-post-gate assembly 100 is disposed with fence gate 105 in an open position, fork member 85 is pivoted downwardly from mated fence gate latch member 105 and thereby released therefrom. Referring now to FIGS. 2A and 9, fence gate 105 is now depicted in a closed position, i.e., with fork member 85 engaged substantially orthogonally with vertical edge portion 125 of fence gate member 105. It will be appreciated that fence gate member 105 is pivotably mounted upon a proximate edge of gate post 110 (not shown) and configured for fork member 85 to be received at and securely enclosing vertical edge portion 125 thereof. Accordingly, it will be readily understood by those skilled in the art that the length of fork member 85 should be long enough to substantially horizontally enclose proximal vertical edge member of fence gate 105 in order to sustain closure thereof. Contrariwise, when fence gate assembly 80 is disposed in an open position, fork member 85 is pivoted vertically downwards from mated fence gate latch member 105 and thereby released therefrom.

Still referring to FIGS. 2A and 9, it is illustrated that gate latch embodiment 10 readily accommodates fence-gate configurations that have a wide range of distances therebetween. Thus, as shown in FIG. 2A, the distance between fence post 115 and proximal edge 110 of fence gate 105 is typically relatively small and represented herein as "D1." Contrariwise, as shown in FIG. 9, there is a greater distance between fence post 115' and proximal edge 110' of fence gate 105' represented herein as "D2" which would nevertheless be accommodated by the functionality taught hereunder, manifest by fork member 85 within fork assembly 80 engaging gate 105', so long as distance D2 is essentially less than the length of fork member 85, whereupon fork member 85 may still securably engage proximal edge 110' of fence gate 105'.

Again collectively referring to FIGS. 1-9, there is seen housing member 15 having opposing substantially parallel and preferably congruent pair of side wall members 20A and 20B affixed perpendicularly to mounting plate member 30 with wall members 20A-B being spaced apart sufficiently to fixedly receive slide sleeve member 40 therebetween. Slide sleeve member 40 is disposed in a parallel relationship with pair of side wall members 20A-B and is configured to accommodate bolt slide member 60 which slides from a first position while being engagedly interlocked with lip member 95 of fork assembly 80—lip member 95 being locked in position with tongue member 90—to a second position while tongue member 90 of bolt slide member 60 is disengaged from lip member 95 of fork assembly 80, and thus disposed in an unlocked position relative to associated tongue member 90. It will be appreciated that bolt slide member 60 comprises release lever 65 at one end and tongue member 90 at the other opposite end thereof.

Figure 3:
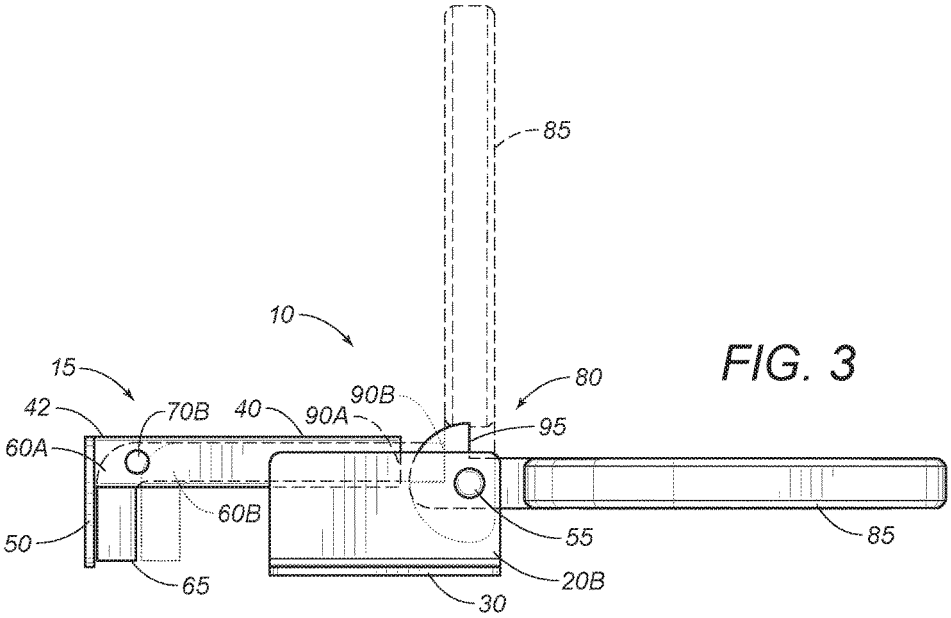
FIG. 3 depicts a right side view of the open latch embodiment illustrated in FIGS. 1, 1A and 1B with the corresponding closed latch position illustrated in FIGS. 2 and 2A depicted with dotted lines.
Figure 4:
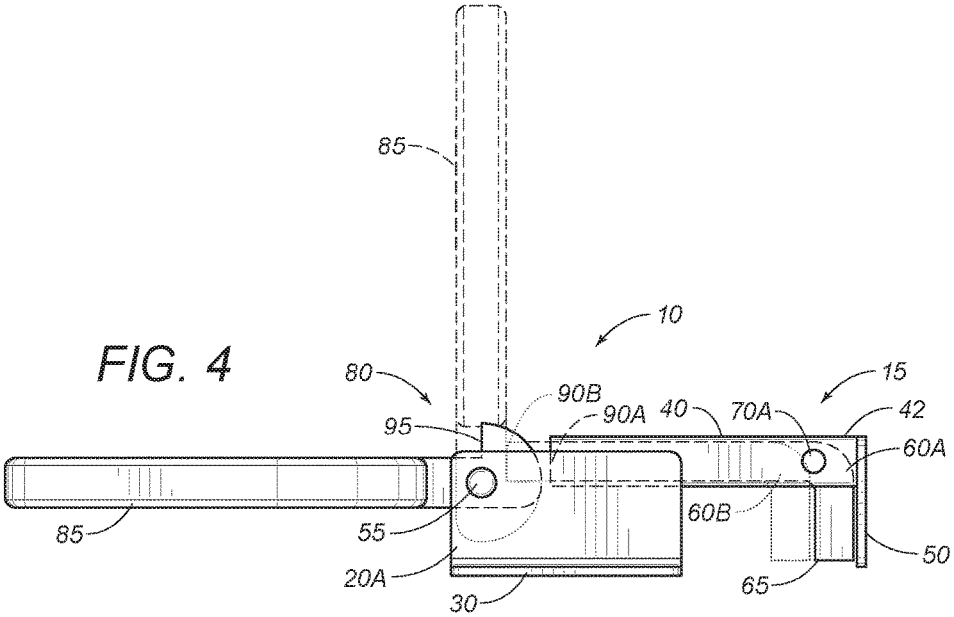
FIG. 4 depicts a left side view of the open latch embodiment illustrated in FIGS. 1, 1A and 1B with the corresponding closed latch position illustrated in FIGS. 2 and 2A depicted with dotted lines.
Figure 5:
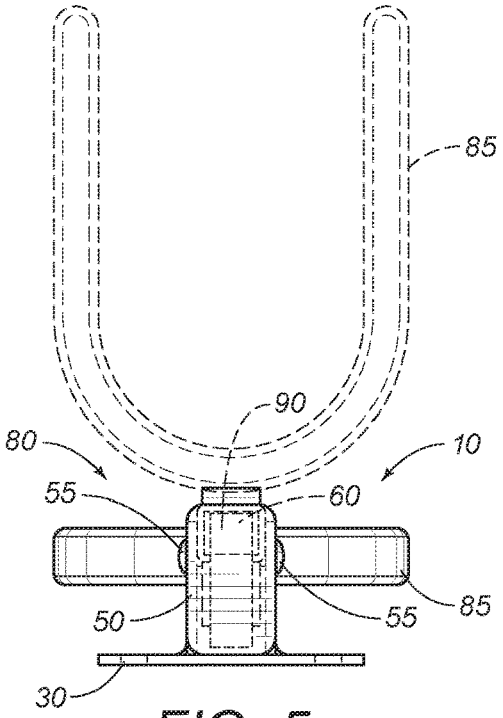
FIG. 5 depicts a rear view of the open latch embodiment illustrated in FIGS. 1, 1A and 1B with the corresponding closed latch position illustrated in FIGS. 2 and 2A depicted with dotted lines.
Figure 6:
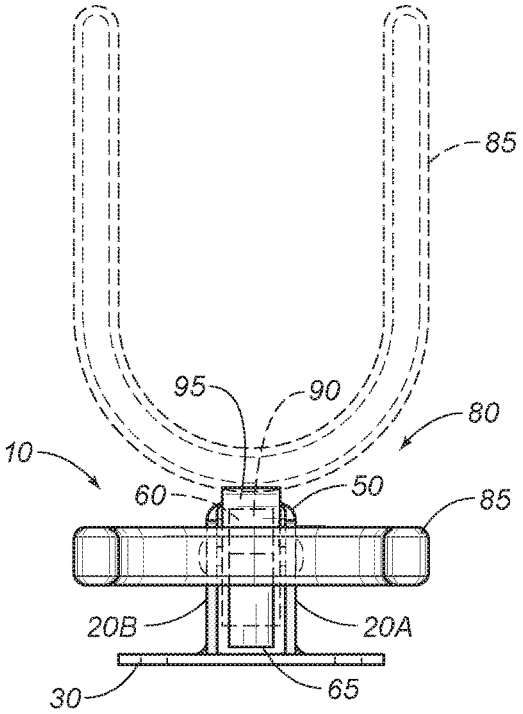
FIG. 6 depicts a front view of the open latch embodiment illustrated in FIGS. 1, 1A and 1B, with the corresponding closed latch position illustrated in FIGS. 2 and 2A depicted with dotted lines.

Now focusing on FIGS. 1, 1A and 1B, with the instant gate latch 10 open as a consequence of fork assembly 80 disposed in a linear relationship with the axis of housing member 15, numeral 60A illustrates slide bolt member 60 being in a disengaged position resting upon slide sleeve retainer member 50, and numeral 90A similarly illustrates the end of disengaged slide bolt member 60. Next, it will be understood that, once slide bolt member 60 slides toward fork assembly 80, and as illustrated by numeral 60B, slide bolt member 60 is now engaged wherein it has become interlocked with lip member 95 at end 90B, To clarify how the structure disclosed herein is functionally related to this engagement and disengagement relationship, the long dashes depicted throughout the figures represent the disengaged "A" position, i.e., numerals 60A and 90A, while the dotted lines depicted throughout represent the engaged "B" position, i.e., numerals 60B and 90B. Similarly, FIGS. 2A, 3, 4, illustrate the instant gate latch 10 closed as a consequence of fork assembly 80 disposed in an orthogonal relationship with the axis of housing member 15. FIGS. 7 and 8 depict top and bottom views, respectively, of the relative positioning of these implicated components when the gate latch embodiment is disposed in an open or closed latch configuration.

For an equestrian to emplace latch assembly 10 into an open position (see FIG. 1A) from a closed position (see FIG. 2A) and thus unlatch gate latch 10 in situ on fence gate 105, the equestrian would urge the horse being ridden to stand proximal to fence gate 105, then with one hand uninterruptedly controlling the horse reins, the equestrian would reach out toward the gate latch and apply slight thumb pressure to lift or press slide lever member 65 toward end portion 42 of slide sleeve 40, thereby causing tongue member 90 to be released from being interlocked with mated lip member 95, wherein bolt slide member 60 is caused by gravity-bias to drop into a vertically downward position, in turn, consequently causing fork member 85 to likewise hang vertically downward from pivot pin member 55 due to gravitational force, wherein fence gate 105 becomes disposed in an open position. Simultaneously with slide lever member 65 being lifted within slide sleeve member 40—with its upward movement being delimited by slide retainer member 25—lip member 95 of tongue member 90 disposed immediately thereabove, is, in turn, displaced from slide member 60. It should be evident to those conversant in the art that this displacement causes fork member 85 to be released from its substantially horizontal, closed position to a substantially vertical, open position. Hence, once slide member 60 is no longer inhibited by interlocked tongue member 90 and lip member 95, the force of gravity urges slide member 60 to slide downwardly within slot member 40 delimited therebelow being within slot member 45. This, in turn, causes fork member 85 of fork assembly 80 to likewise be freely hanging downwards while fence gate 105 remains open.

It will be appreciated that, in order to close fence gate 105, an equestrian would similarly urge the horse being ridden to be positioned proximal thereto. Then, with one hand controlling the horse reins, the free hand would be invoked to impose slight lift pressure upon fork member 85 until it is raised sufficiently to become locked into a substantially horizontal position, essentially being emplaced and secured upon fence gate proximal edge 110. This secure horizontally positioning of fork member 85 enclosing fence gate edge 110 is attributable to tongue member 90 simultaneously being interlocked with matched lip member 95, which, in turn, causes slide release member 65 of slide member 60 to be locked into its neutral position within slot member 45.

As should be readily understood by those skilled in the art, the rotational movement of fork member 85 from a horizontal-fence gate locked-disposition to a vertical-fence gate open-disposition, and vice versa, is achieved through pivot pin member 55. It has been elucidated that, in order to open locked fence gate member 10, slide sleeve slot member 45 accommodates the thumb of an equestrian or any other farm-hand or ranch-hand or like personnel to easily be positioned to raise slide release lever member 65 to achieve the hereinbefore described functional relationship involving downward movement of bolt slide member 60 within slide sleeve member 40, while fork member assembly 80 correspondingly freely hangs vertically downwards subject to gravity-bias. Those skilled in the art will, of course, appreciate that the slide sleeve slot member should nevertheless be judiciously configured so that it's unlikely if not impossible for a farm or ranch animal or the like to urge the slide release lever member upwards and thereby open the fence gate. Obviously, it's imperative that the gate latch only be unlatched and the fence gate opened by authorized personnel.

It should be evident to those skilled in the art that simultaneously slide member 60 is released, since tongue member 90 and lip member 95 cease being interlocked, wherein bolt slide member 60 is caused to slide into a locked position as it travels upwards within slide sleeve member 40 until being delimited atop by slide sleeve retainer member 50.

It should also be evident that, once gate member 105 is latched into a closed position, that this closure may be further secured using a padlock or like locking device (not shown) by a farm-hand or ranch-hand emplacing such locking device through pair of padlock holes 70A-B. It should also be clear to those skilled in the art that, while embodiments of the present invention are conducive for use by equestrian ranch-hands or farm personnel, such embodiments may also, of course, be readily used by pedestrian personnel and the like.

The following is a tabulation of the components depicted in the drawings:

Component Listing

| Numeral | Component | Explanation |
|---|---|---|
| 10 | Gate latch apparatus | Substantially linear configuration when gate unlatched |

-continued

| Component Listing | | |
|---|---|---|
| Numeral | Component | Explanation |
| 15 | Housing member | |
| 20A-B | Housing Side wall members, pair | Parallel; preferably congruent |
| 30 | Mounting plate member | Mounting gate latch upon fence post |
| 35A-D | Bolt holes for mounting latch to fence post | disposed at each corner of mounting plate |
| 37A-D | Bolts | corresponding to bolt holes 35A-D |
| 40 | Slide Bolt Sleeve member | |
| 42 | Remote end of sleeve member | Slide sleeve retainer adjacent thereto |
| 45 | Slide Bolt Sleeve Slot member | |
| 50 | Retainer member atop Slide Sleeve member | Keeper for slide sleeve |
| 55 | Pivot pin member | Enables rotation of fork assembly |
| 60 | Slide Bolt Member | Gravity bias when lip member released; Slides downward via gravity, when released |
| 60A | Disengaged position | |
| 60B | Engaged position | |
| 65 | Slide Member Release Lever | Typically thumb-activated; parallel to Slide member retainer |
| 70A-B | Padlock holes | enable padlock to secure closed gate |
| 80 | Fork Assembly | |
| 85 | Fork member | Horseshoe shape |
| 90 | Tongue member, remote end of slide bolt member | Pivots along with pivot pin (55), causing lip member to engage or disengage |
| 90A | Position of tongue member on slide bolt prior to being engaged with lip member 95 | |
| 90B | Position of tongue member on slide bolt engaged with lip member 95 | |
| 95 | Lip member, remote end of fork assembly, opposite end of fork member | Keeps slide member in locked position until released, opening latch; when positioned below gravity locking bolt member, prevents sliding downwards under force of gravity |
| 100 | Gate-Fence-Post Assembly | |
| 105 | Fence Gate | |
| 110 | Gate vertical edge | Proximal to fence post |
| 115 | Fence Post | |
| 117 | Vertical edge where latch apparatus attached to fence post | |
| 120 | Fence Assembly | |
| 125 | Vertical edge where fork member engaged with fence gate | |
| D1 | Normal distance between fence post & gate | |
| D2 | Greater distance between fence post & gate | D2 > D1 |

Other variations and modifications will, of course, become apparent from a consideration of the structures and techniques hereinbefore described and depicted. Accordingly, it should be clearly understood that the present invention is not intended to be limited by the particular features and structures hereinbefore described and depicted in the accompanying drawings, but that the present invention is to be measured by the scope of the appended claims.

What is claimed is:

1. A gate latch apparatus for manually single-handedly opening and closing a gate pivotally attached to a fence having a fence post on one side thereof and a gate on the other opposite side thereof, said gate latch apparatus comprising:

a housing member having a longitudinal axis bounded by a pair of spaced-apart parallel side wall members fixedly enclosing an elongated slide sleeve member comprising a slide member release lever;

a housing member having a longitudinal axis bounded by a pair of spaced-apart parallel side wall members fixedly enclosing an elongated slide sleeve member comprising a slide member release lever fixedly attached at one end thereof and a lip member fixedly attached at an end opposite of said slide member release lever;

said elongated slide sleeve member configured to accommodate a bolt slide member for sliding therewithin from a first position engaged with said lip member to a second position disengaged from said lip member and having a slide retainer member disposed at a first end of said slide sleeve member atop thereof;

a planar mounting plate member affixed to the rear of said slide sleeve member and disposed substantially orthogonal to said pair of spaced-apart parallel side wall members, and having a plurality of holes for being fixedly mounted substantially vertically to said fence post;

a fork assembly disposed at a second end of said housing member opposite of said slide retainer member and comprising a fork member disposed at an end thereof and pivotally engaged with said pair of spaced-apart side wall members by a pivot pin member disposed orthogonally therethrough and a tongue member disposed at an end thereof opposite of said fork member and configured to be paired with said lip member;

said fork member rotating from a first position in a linear relationship with said housing member to a second position in an orthogonal relationship with said housing member, enabled by cooperation between said slide member release lever and said lip member in conjunction with said mated tongue member; and said gate being open when said fork member is disposed in said first position and being closed when said fork member is disposed in said second position and simultaneously disposed in an engagement relationship with a proximal vertical edge of said gate.

2. The gate latch apparatus recited in claim 1, wherein said slide member release lever is sized with sufficient clearance to accommodate insertion of a finger of said single-hand to raise the lever thereof.

3. The gate latch apparatus recited in claim 2, wherein, when said fork member is disposed in said second position in an orthogonal relationship with said housing member, said tongue member is locked into position with said lip member.

4. The gate latch apparatus recited in claim 3, wherein, when said fork member is disposed in said first position in a linear relationship with said housing member, said slide member release lever is lifted said manually single-handedly, said tongue member is unlocked from said lip member thereby enabling said slide member to slide from said first end of said housing member to said second end thereof by gravity bias imposed thereupon.

5. The gate latch apparatus recited in claim 4, wherein said planar mounting plate member has a plurality of mounting holes disposed upon the top surface thereof for being fixedly mounted to said fence post by a like plurality of fastener members sized to be securely received thereby; and said plurality of mounting holes comprises one of said mount holes disposed at each corner of said planar mounting plate member.

6. The gate latch apparatus recited in claim 5, wherein said fork member is sized of sufficient length to securely engage said proximal vertical edge of said gate when substantial deviations occur in alignment of or separation between said gate and said fence post.

7. The gate latch apparatus recited in claim 5, wherein said opening and closing of said gate latch is orchestrated by an equestrian said single-handedly while uninterruptedly sustaining contact with a horse's reins.

* * * * *